US007261598B1

(12) United States Patent
Tseng

(10) Patent No.: US 7,261,598 B1
(45) Date of Patent: Aug. 28, 2007

(54) ELECTRICAL CONNECTOR

(75) Inventor: Tien-Chih Tseng, Taipei (TW)

(73) Assignee: Longwell Company, Taipei (TW)

( * ) Notice: Subject to any disclaimer, the term of this patent is extended or adjusted under 35 U.S.C. 154(b) by 0 days.

(21) Appl. No.: 11/647,172

(22) Filed: Dec. 29, 2006

(30) Foreign Application Priority Data

May 8, 2006 (TW) ..... 95207848 U
Jun. 23, 2006 (TW) ..... 95211036 U

(51) Int. Cl.
*H01R 13/648* (2006.01)

(52) U.S. Cl. ..... 439/607

(58) Field of Classification Search ..... 439/607–610
See application file for complete search history.

(56) References Cited

U.S. PATENT DOCUMENTS 6,247,967 B1 * 6/2001 Wu et al. ..... 439/607
6,354,876 B1 * 3/2002 Yu ..... 439/607
6,659,791 B1 * 12/2003 Ko et al. ..... 439/353
6,902,425 B2 * 6/2005 Huang ..... 439/495
6,948,954 B1 * 9/2005 Fan ..... 439/137
6,954,363 B2 * 10/2005 Fan ..... 361/816

* cited by examiner

*Primary Examiner*—Truc Nguyen
(74) *Attorney, Agent, or Firm*—Bacon & Thomas, PLLC

(57) ABSTRACT

An electrical connector includes: a terminal element; a grounding element; an insulating housing; a metal shell enclosing the insulating housing; and two solder terminals extended outward from the metal shell. Wherein the grounding element has at least a supporting rib which is utilized to enhance the structure strength of the grounding element so as to ensure a good grounding effect in limited space. Besides, every one of those solder terminals of the metal shell has a winding portion bended in a tilting angle. Additionally, the metal shell further includes a partner-fitting portion, and two short sides of the peripheral thereof bended backward to form a chamfer-type guiding portion so as to make a corresponding connector connect to the electrical connector smoothly.

30 Claims, 11 Drawing Sheets

ELECTRICAL CONNECTOR

BACKGROUND OF THE INVENTION

1. Field of the Invention

The present invention relates to a connector, and more especially, to an electrical connector with good grounding effect.

2. Background of the Related Art

Electrical connector is widely applied in the electrical apparatus, such as the notebook, the mobile phone and the fax. The electrical connector combining with a male connector is electrically connected to a printed circuit board (PCB) of a host, to provide the electrical connection between two electrical apparatus.

In general, the electrical connector includes an insulating housing, a plurality of grounding terminals and signal terminals which are arranged in the insulating housing separately and parallelly, and a cover shell holding on the insulating housing, wherein the grounding terminals contact with the cover shell to provide the grounding effect. The usual grounding terminals are made by punching a metal piece to form a plurality of terminal structures. However, the plurality of terminal structures make the whole grounding structure too wide and thin, and lead the middle portion of the grounding structure into bend, and to cause the sinking phenomenon occurs in the middle portion of the grounding structure. An improve method is to fabricate the grounding piece with flat-board shape to increase the structure intensity of the grounding piece, however, the grounding piece and the signal terminals can not establish a adequate grounding path in this method, and so as to decrease the grounding effect.

SUMMARY OF THE INVENTION

For solving the foregoing problems, one object of this invention is to provide an electrical connector to facilitate the fabrication and simplify the fabrication processes.

For effectively filtrating the noise interference, one object of this invention is to provide an electrical connector to construct a complete grounding circuit between the male connector and the electrical connector by the terminals of the terminal component accurately corresponding to the cantilevers of the grounding component. Furthermore, the loading forces on the male connector are equal due to the cantilevers corresponding to the terminals, and thus avoid the unequal force causing the poor connection of the electrical connector or the male connector.

For solving the defect of the instability in the middle of the grounding component due to its too wide and too thin design, one object of this invention is to provide an electrical connector to use a supporting rib to strengthen the structure intensity of the grounding component, and ensure that the grounding component and the terminal component still have the good grounding effect in the limited design space.

One object of this invention is to provide an electrical connector, wherein the winding portions with tilting angles θ and long holes on the winding portions are used to increase the welding areas to make the solder terminal be welded on PCB with high stability.

One object of this invention is to provide an electrical connector, wherein the grounding component is designed as one-piece type with good holding intensity to microminiaturize the size of the connector and decrease the material.

Accordingly, one embodiment of the present invention provides an electrical connector which includes: a terminal component with a plurality of terminals; a grounding component including: a main axis, a folding piece, two side arms and a plurality of cantilevers, wherein, two ends of the main axis and two ends of the folding piece co-connect two side arms, respectively, the plurality of cantilevers are formed on the main axis toward the folding piece and at least one of the cantilevers extends to the folding piece as a supporting rib, and each side arm stretches an elastic piece on one end of the side arm; an insulating housing covering the grounding component and the terminal component to make the terminals of the terminal component corresponding to the cantilevers of the grounding component and expose portions of the terminals; a metal shell covering the insulating housing and exposing the terminals, wherein, the elastic piece stretches from the insulating housing to contact a inner wall of the metal shell; and two solder terminals extending form two sides of the metal shell and each solder terminal having a winding portion bended in a tilting angle θ.

Another embodiment of the present invention provides an electrical connector which includes: a terminal component with a plurality of terminals; a grounding component including a main axis with a plurality of indentations on a front edge of the main axis; a plurality of cantilevers extending from the front edge of the main axis and between any two adjacent indentations; and two side arms respectively arranged on two opposite ends of the main axis; an insulating housing covering the grounding component and the terminal component to make the terminals of the terminal component corresponding to the cantilevers of the grounding component and expose portions of the terminals; and a metal shell covering the insulating housing and exposing the terminals, wherein, a plurality of interfering pieces corresponding to the indentations are formed on a rear edge of the metal shell to interfere with the indentations.

DETAILED DESCRIPTION OF THE INVENTION

Figure 1A:
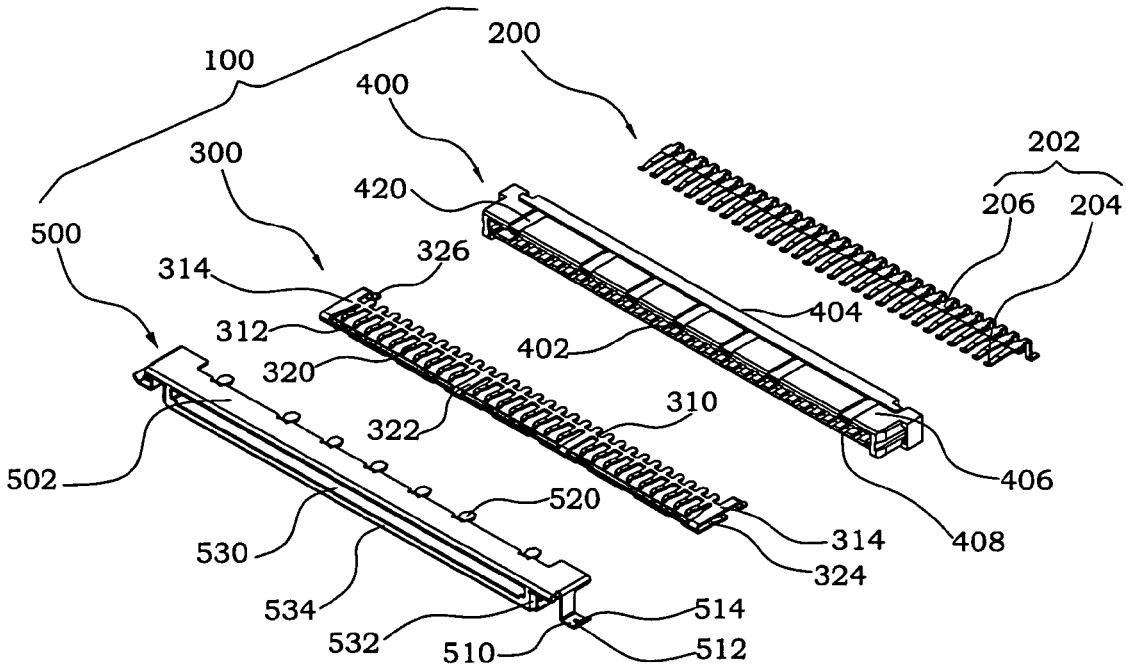
FIG. 1A is a disassembling structure diagram illustrating an electrical connector in accordance with one embodiment of present invention.

FIG. 1A is a disassembling structure diagram illustrating an electrical connector in accordance with one embodiment of present invention. As shown in FIG. 1A, an electrical connector 100 includes a terminal component 200, a grounding component 300, an insulating housing 400 and a metal shell 500. The terminal component 200 includes a plurality of terminals 202 made by punching a metal piece and the terminals 202 are applied to as signal terminals. In the present embodiment, every terminal 202 includes a contacting portion 204 and a wedging portion 206, wherein the contacting portion 204 is used to contact with a terminal of a male connector (not shown in FIG. 1A) and the wedging portion 206 is used to help the terminal component 200 wedged in the insulating housing 400. As shown in FIG. 1A, the grounding component 300 includes a main axis 310, a folding piece 312, two side arms 314 and a plurality of cantilevers 320, wherein two ends of the main axis 310 and two ends of the folding piece 312 co-connect the two side arms, respectively, the cantilevers 320 are formed on the main axis 310 toward the folding piece 312 and at least one of the cantilevers 320 extends to the folding piece 312 as a supporting rib 322, further, each side arm 314 stretches an elastic piece 324 on one end of the side arm 314. In one embodiment, besides stretching the elastic piece 324 on one end of the side arm 314, a welding piece 326 is also stretched on another end of the side arm 314, wherein the welding piece 326 and the elastic piece 324 are toward the same direction. In the present embodiment, the grounding component 300 with wide, thin and ⊏-shape is inserted into the insulating housing 400 easily, and by the design of the supporting rib 322, the structure intensity of the grounding component 300 is strong enough to overcome the bend phenomenon in the middle of the grounding component 300 due to its too wide and too thin design, and so as to not affect the grounding effect in the middle of the grounding component 300. Furthermore, the supporting rib 322 not only strengthens the structure intensity of the grounding component 300, but also ensures that the grounding component 300 and the terminal component 200 still have the good grounding effect in the limited design space. In the present embodiment, the grounding component 300 is made by punching a metal piece.

Continuously, the insulating housing 400, which is made of the plastics for example, is used to cover the terminal component 200 and the grounding component 300, wherein the locations of the terminals 202 of the terminal component 200 correspond to the locations of the cantilever 320 of the grounding component 300, and the portions of the terminals 202 are exposed outside the insulating housing 400. In one embodiment, the shoulder portions of the terminals 202 are covered in the insulating housing 400. In another embodiment, the terminal component 200 and the grounding component 300 are inserted into the insulating housing 400 from different directions, for example, the grounding component 300 is inserted from the front 402 of the insulating housing 400 and the terminal component 200 is inserted from the back 404 of the insulating housing 400, wherein by using the elastic pieces 324, the grounding component 300 is wedged in the insulating housing 400, and the folding piece 312 partly covers the insulating housing 400. Inserting the grounding component 300 from the front 402 of the insulating housing 400 can facilitate the fabrication and simplify the fabrication process. In the present embodiment, the insulating housing 400 further includes a plurality of the grooves 420 formed on the top surface 406 and the bottom surface 408 to be inserted by the metal shell 500.

Figure 1B:
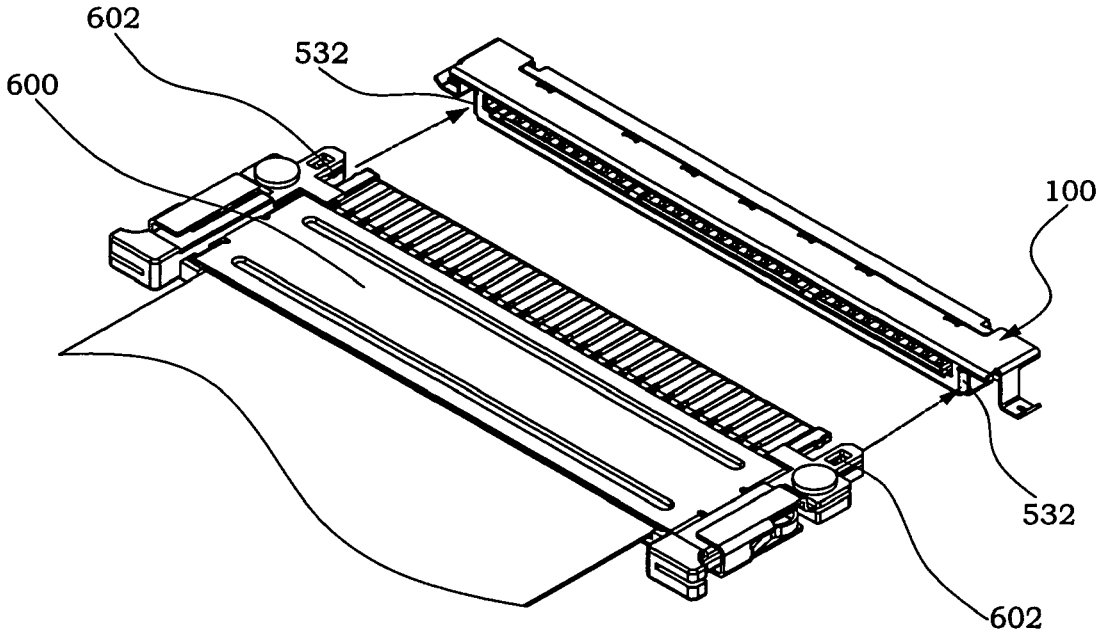
FIG. 1B is a buckling diagram illustrating the latch type male connector and the combinative electrical connector in accordance with one embodiment of present invention.

Accordingly, the metal shell 500 of the electrical connector 100 covers the insulating housing 400 and exposes the portion of the terminals 202 to be welded easily, wherein the elastic piece 324 stretches from the insulating housing 400 to contact the inner wall of the metal shell 500 to achieve the grounding purpose. Further, two solder terminals 510 are respectively extend outwardly from two sides of the top surface 502 of the metal shell 500, and every solder terminal 510 has a winding portion 512 bended in a tilting angle. In one embodiment, the tilting angle is between 45 degrees to 60 degrees, and a long hole 514 is formed on the winding portion 512. The winding portion 512 and the long hole 514 are used to increase the welding area to make the solder terminal 510 be welded on the PCB with high stability. In the present embodiment, a plurality of insertions 520 is formed on the top surface 502 and the bottom surface 504 of the metal shell 500, and the insertions 520 are inserted into the grooves 420 on the top surface 406 and the bottom surface 408 of the insulating housing 400. In one embodiment, the metal shell 500 further includes a partner-fitting portion 530 with a periphery and two short sides of the periphery are bended backwardly to form a guiding portion 532 with chamfer type to guide the male connector, such as the latch type male connector, and make the male connector buckle with the electrically connector 100 without any obstruction. As shown in FIG. 1B, it is a buckling diagram illustrating the latch type male connector and the combinative electrical connector, two lock portions 602 of the latch type male connector 600 buckle with the electrically connector by the guidance of the guiding portion 532 with chamfer type. Next, please refer to FIG. 1A, a retaining wall 534 is formed on the periphery of the partner-fitting portion 530 to cover the portion of the insulating housing 400, wherein the height of the retaining wall 534 does not affect the insertion of the male connector, and the retaining wall 534 has the function of guiding the male connector 600 into the electrical connector 100 and this function is the same as the function of the guiding portion 532 with chamfer type. In the present embodiment, the metal shell 500 comes one piece.

Continuously, please refer to FIG. 2A, FIG. 2B, FIG. 2C and FIG. 2D, FIG. 2A and FIG. 2B are respectively a three-dimension diagram illustrating the combinative electrical connector and its partial enlarged diagram, and FIG.

Figure 2A:
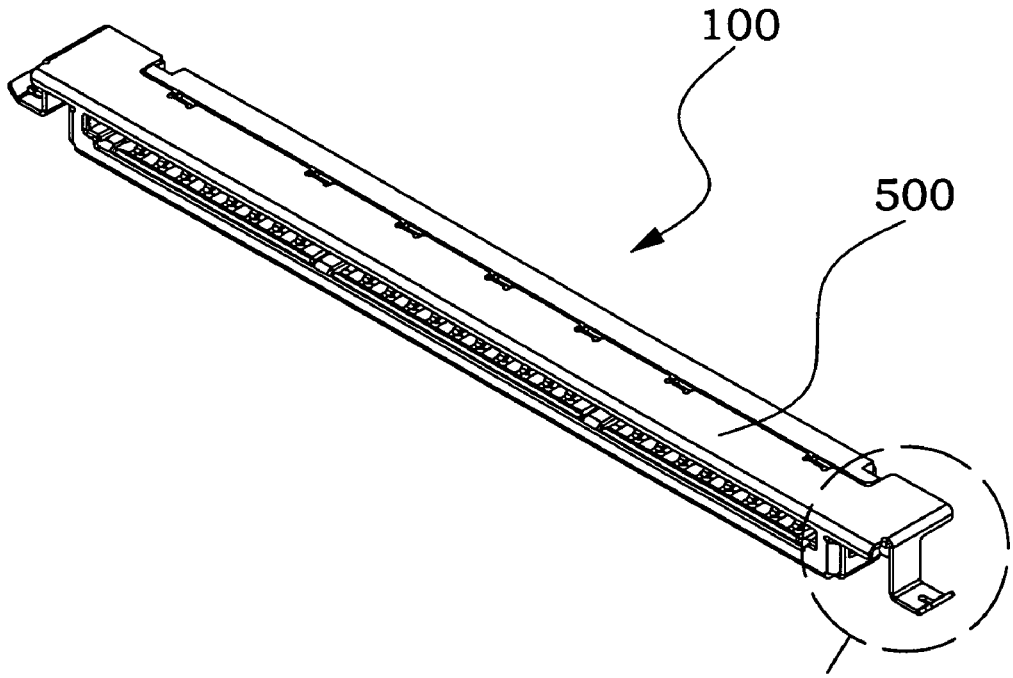
FIG. 2A is a three-dimension diagram illustrating the combinative electrical connector in accordance with the electrical connector in FIG. 1A.
Figure 2B:
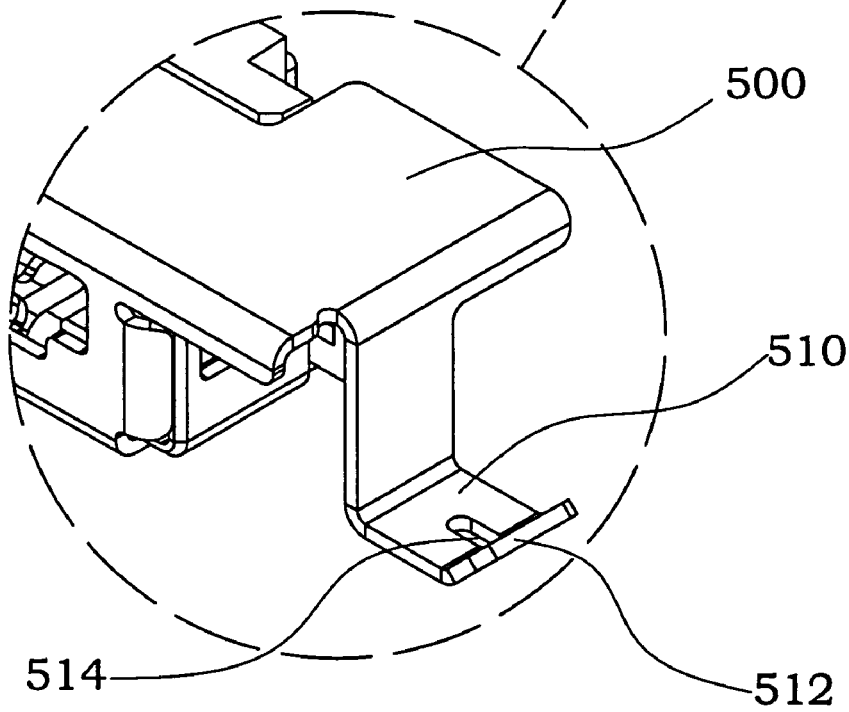
FIG. 2B is a partial enlarged diagram of FIG. 2A.
Figure 2C:
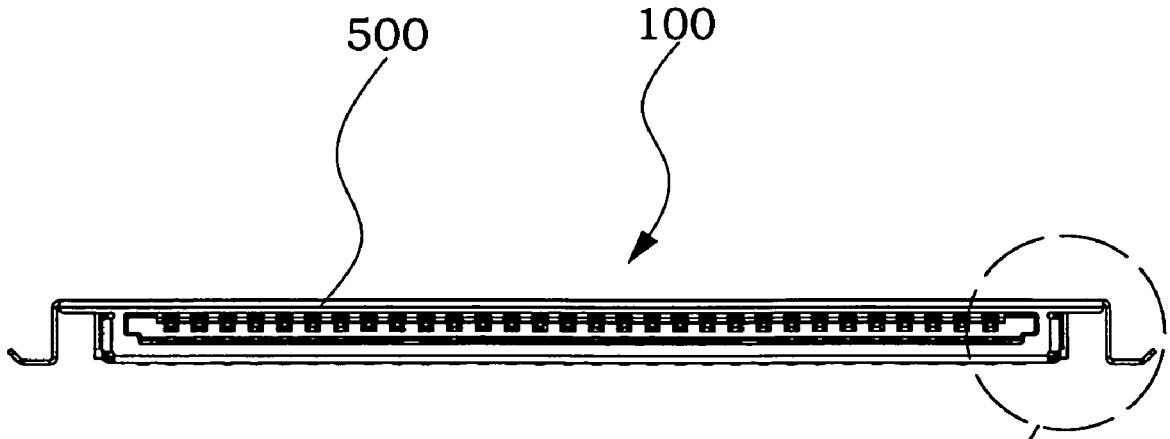
FIG. 2C is a front view diagram illustrating the combinative electrical connector in accordance with electrical connector in FIG. 1A.
Figure 2D:
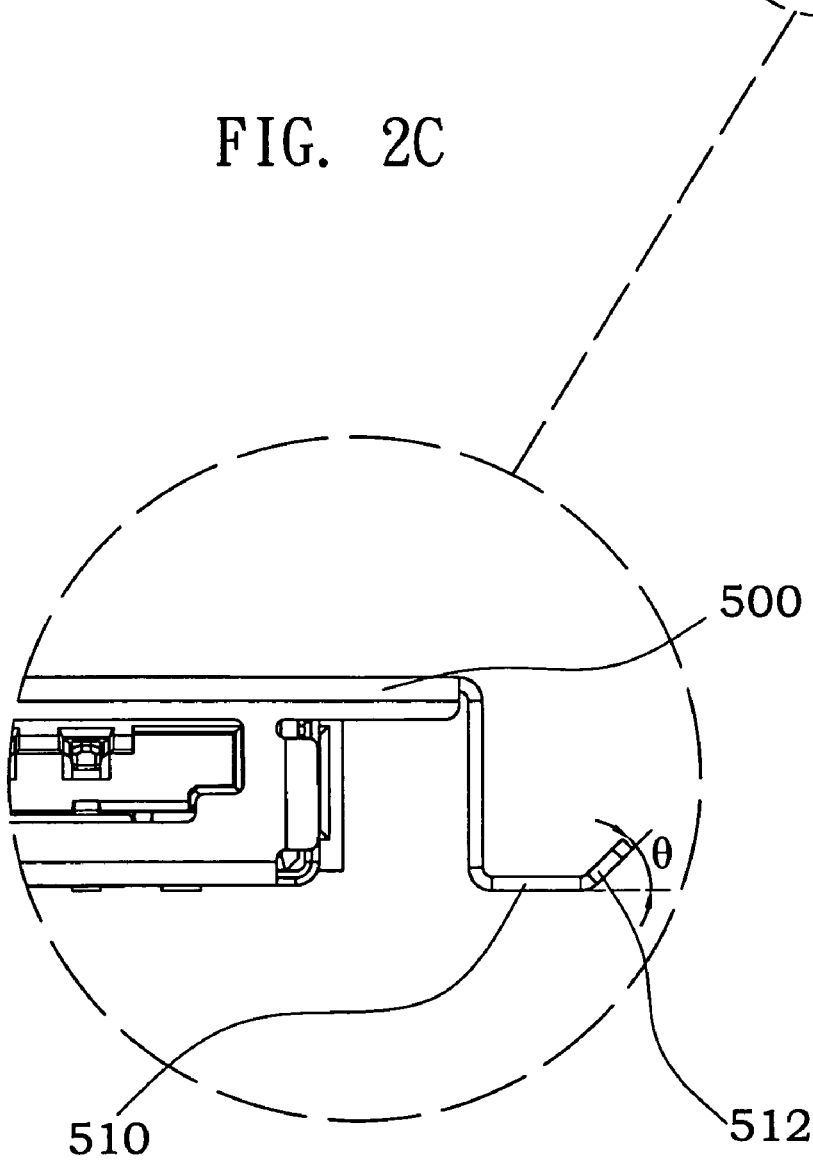
FIG. 2D is a partial enlarged diagram of FIG. 2C.
Figure 3A:
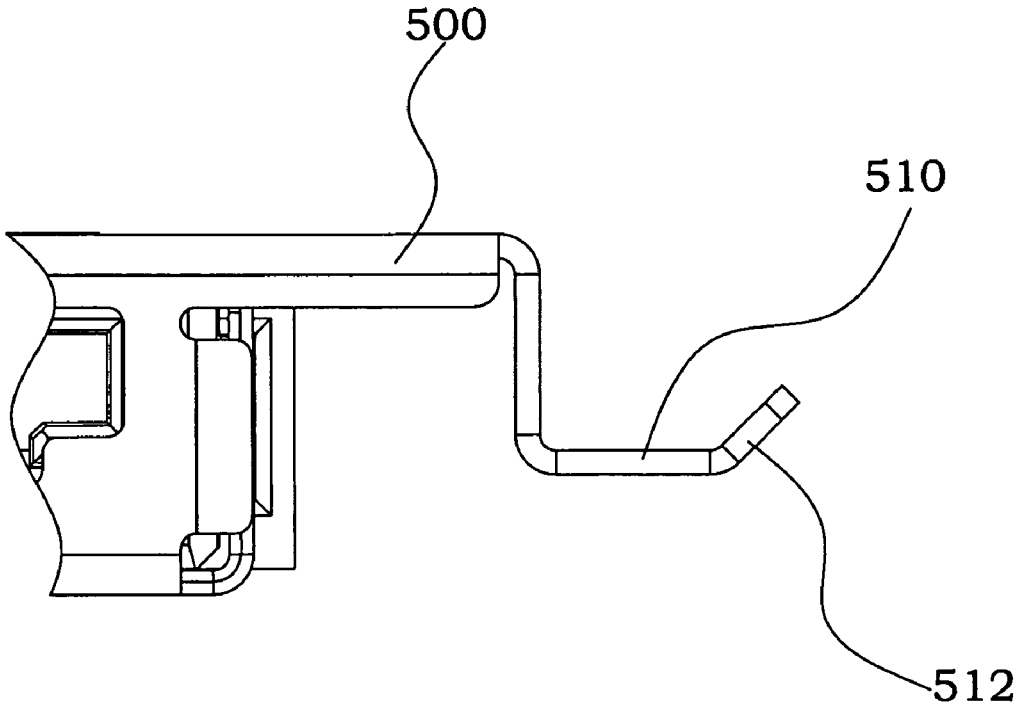
FIG. 3A is a partial enlarged diagram illustrating the metal shells in accordance with one embodiments of present invention.
Figure 3B:
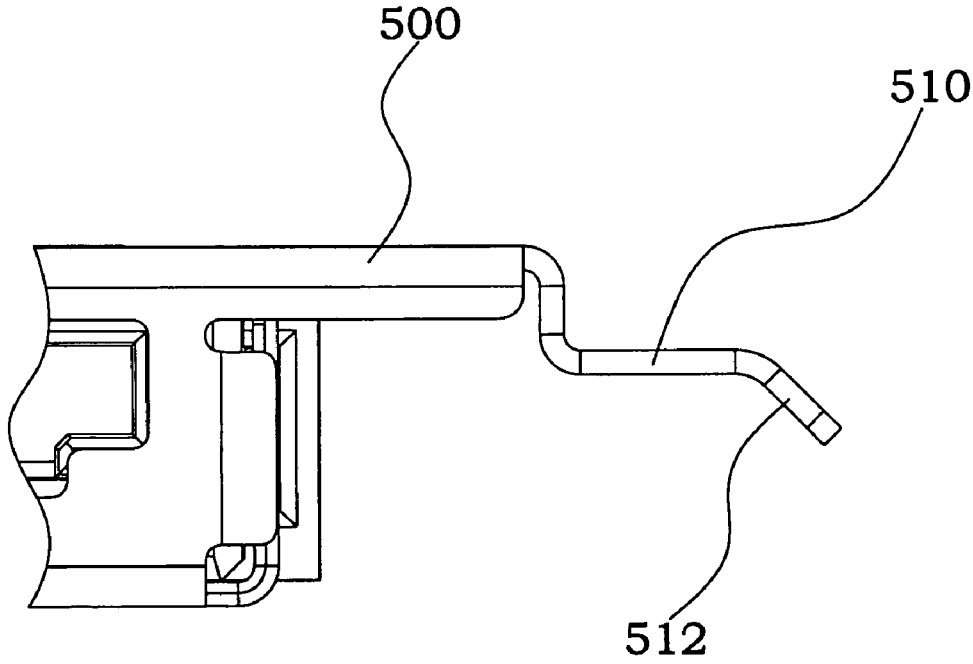
FIG. 3B is a partial enlarged diagram illustrating the metal shells in accordance with another embodiments of present invention.

2C and FIG. 2D are respectively a front view diagram illustrating the combinative electrical connector and its partial enlarged diagram. In the present embodiment, the long holes 514 of the solder terminals 510 of the metal shell 500 are illustrated clearly in FIG. 2A and FIG. 2B, wherein, every long hole 514 is formed on the connection portion between the solder terminal 510 and the winding portion 512. Next, please refer to FIG. 2C and FIG. 2D, the solder terminal 510 has the winding portion 512 bended in a tilting angle θ which is between 45 degrees to 60 degrees, wherein the long holes 514 matches the tilting angleθ, and then when the solder terminals 510 are welded on the PCB, the welding area will increase because of the design of the winding portion 512 with the tilting angle θ to make the welding with high stability. FIG. 3A and FIG. 3B are the partial enlarged diagrams illustrating the metal shells in accordance with different embodiments of present invention, as shown in FIG. 3A and FIG. 3B, the solder terminal 510 can be arranged in the middle of the metal shell 500 or over the metal shell 500 depending on the welding demand of the solder terminal 510, and the winding portion 512 of the solder terminal 510 also can be winded upwardly (as shown in FIG. 3A) or downwardly (as shown in FIG. 3B) to be welded easily.

Figure 4A:
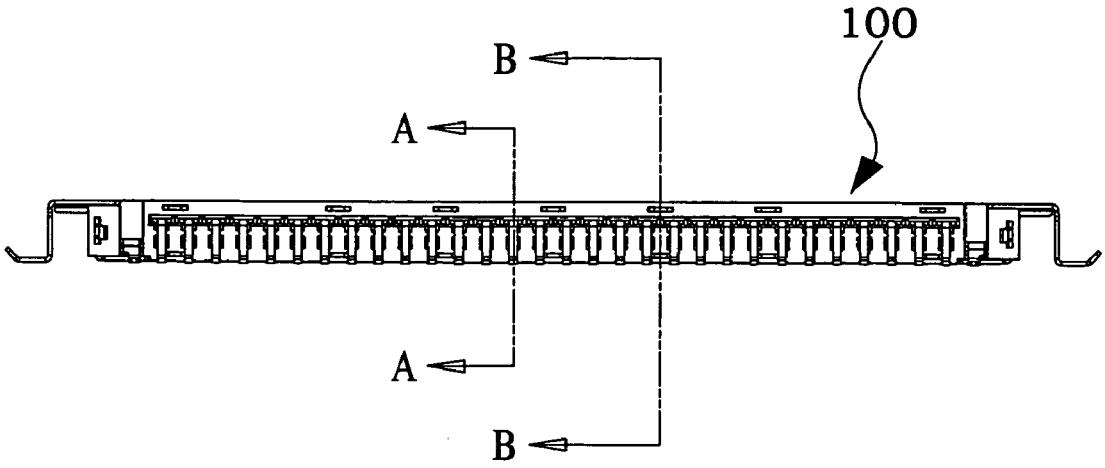
FIG. 4A is a rear view diagram illustrating the combinative electrical connector in accordance with electrical connector in FIG. 1A.
Figure 4B:
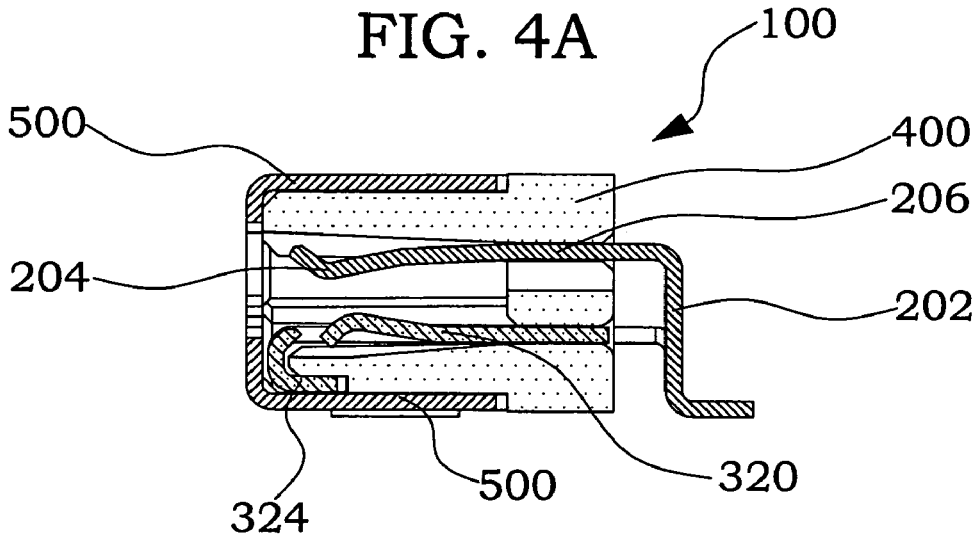
FIG. 4B is a cross-section diagram indicated by the section lines of A-A in FIG. 4A.
Figure 4C:
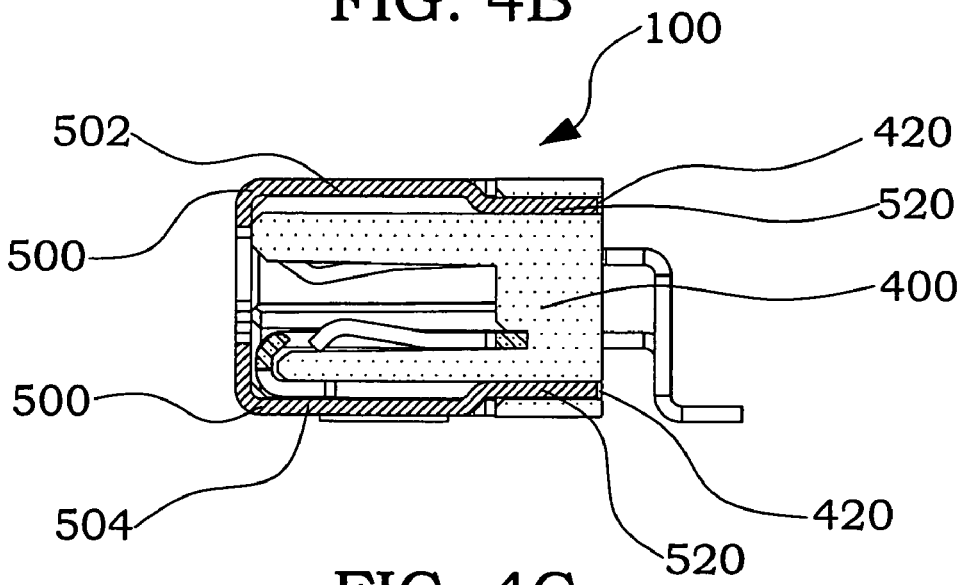
FIG. 4C is a cross-section diagram indicated by the section lines of B-B in FIG. 4A.

Please refer to FIG. 4A, FIG. 4B and FIG. 4C, FIG. 4A is a rear view diagram illustrating the combinative electrical connector, FIG. 4B is a cross-section diagram indicated by the section lines of A-A in FIG. 4A, and FIG. 4C is a cross-section diagram indicated by the section lines of B-B in FIG. 4A. As shown in FIG. 4B, the locations of the terminals 202 of the terminal component and the grounding component are illustrated clearly, wherein the wedging portions 206 of the terminals 202 are wedged into the insulating housing 400 and the contacting portions 204 of the terminals 202 are exposed outside the insulating housing 400 to contact with the terminals of the male connector. When the male connector is inserted into the electrical connector 100, the loading forces of the contacting portions between the grounding component and the terminal component are equal due to the locations of the cantilevers 320 corresponding to the locations of the terminals. Wherein, the grounding component is buckled with the insulating housing 400 by the use of the elastic pieces 324 which then contact with the inner wall of the metal shell 500 to achieve the grounding effect. After inserting the male connector, the terminals of the male connector contact the terminals 202 of the electrical connector 100 by one to one, and the metal shell 500 of the male connector electrically contact with the cantilevers 320 of the electrical connector 100 to reach the grounding effect by the elastic pieces 324 which then contact with the inner wall of the metal shell 500. Wherein a complete grounding circuit is constructed among the male connector, the terminals 202 of the terminal component and the cantilevers 320 of the grounding component, to obtain a good electromagnetic shield and effectively filtrate the noise interference. On the other hand, FIG. 4C clearly illustrates the combinative status of the metal shell 500 and the insulating housing 400, wherein the insertions are extended from the top surface 502 and the bottom surface 504 of the metal shell 500 to respectively be inserted into the grooves 420 of the insulating housing 400 and then fixed on the insulating housing 400.

Accordingly, one of the characteristics in the present invention is to insert the grounding component with insertions into the insulating housing from the front of the insulating housing, wherein the supporting rib can strengthen the structure intensity of the grounding component and the number of the supporting rib can depend on the width and the material thickness of the grounding component. One characteristic of the present invention is to make the solder terminals of the metal shell respectively have winding portions bended in a tilting angle to increase the welding area depending on tilting angle, wherein the winding portion can be winded upwardly or downwardly according to the welding location. Besides, one characteristic of the present invention is to make the two short sides of the periphery of the partner-fitting portion of the metal shell bended backwardly to form a guiding portion with chamfer type to guide the male connector buckling with the electrically connector without any obstruction.

Figure 5:
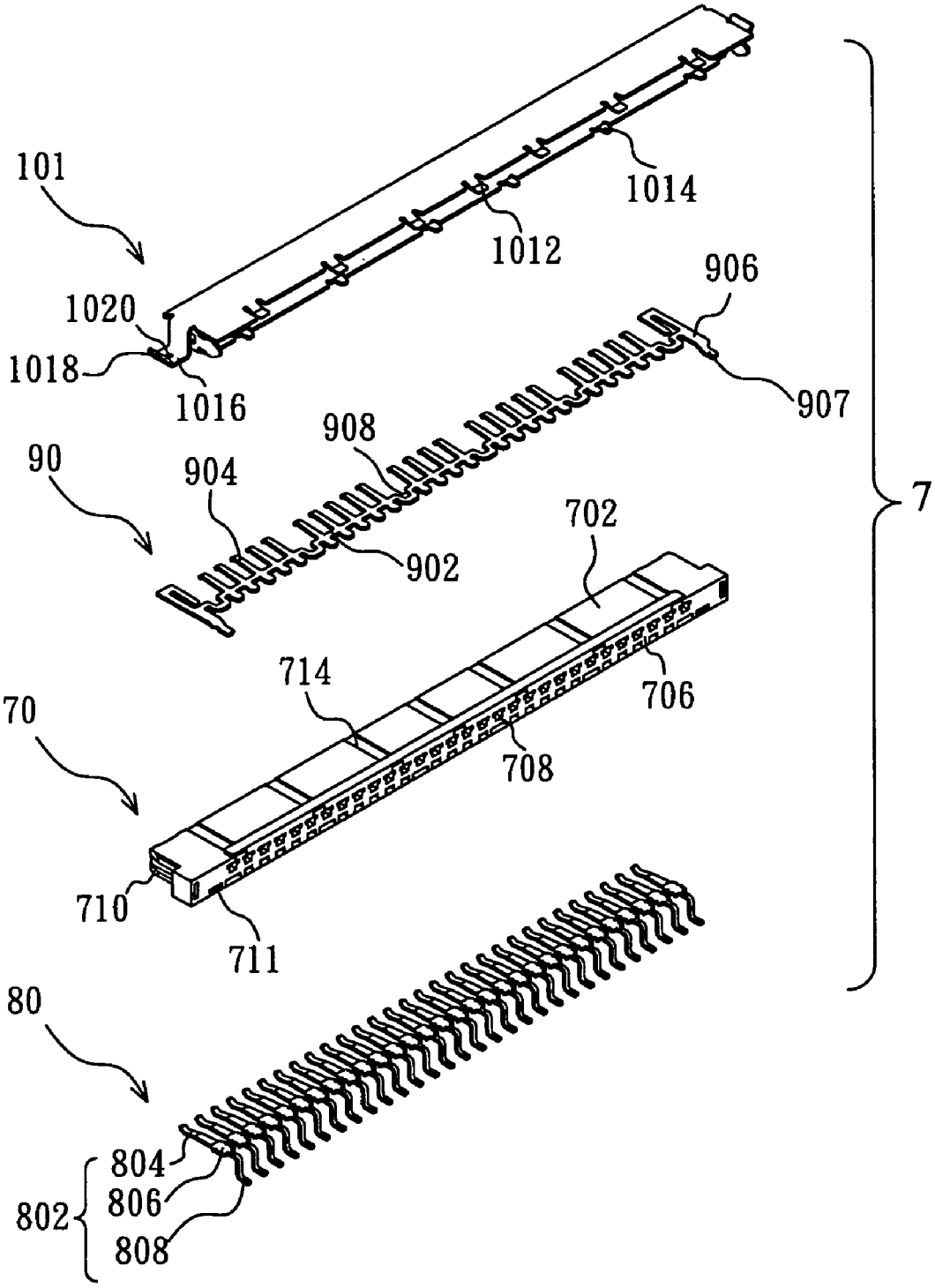
FIG. 5 is a disassembling structure diagram illustrating the electrical connectors in accordance with another embodiment of present invention.
Figure 6:
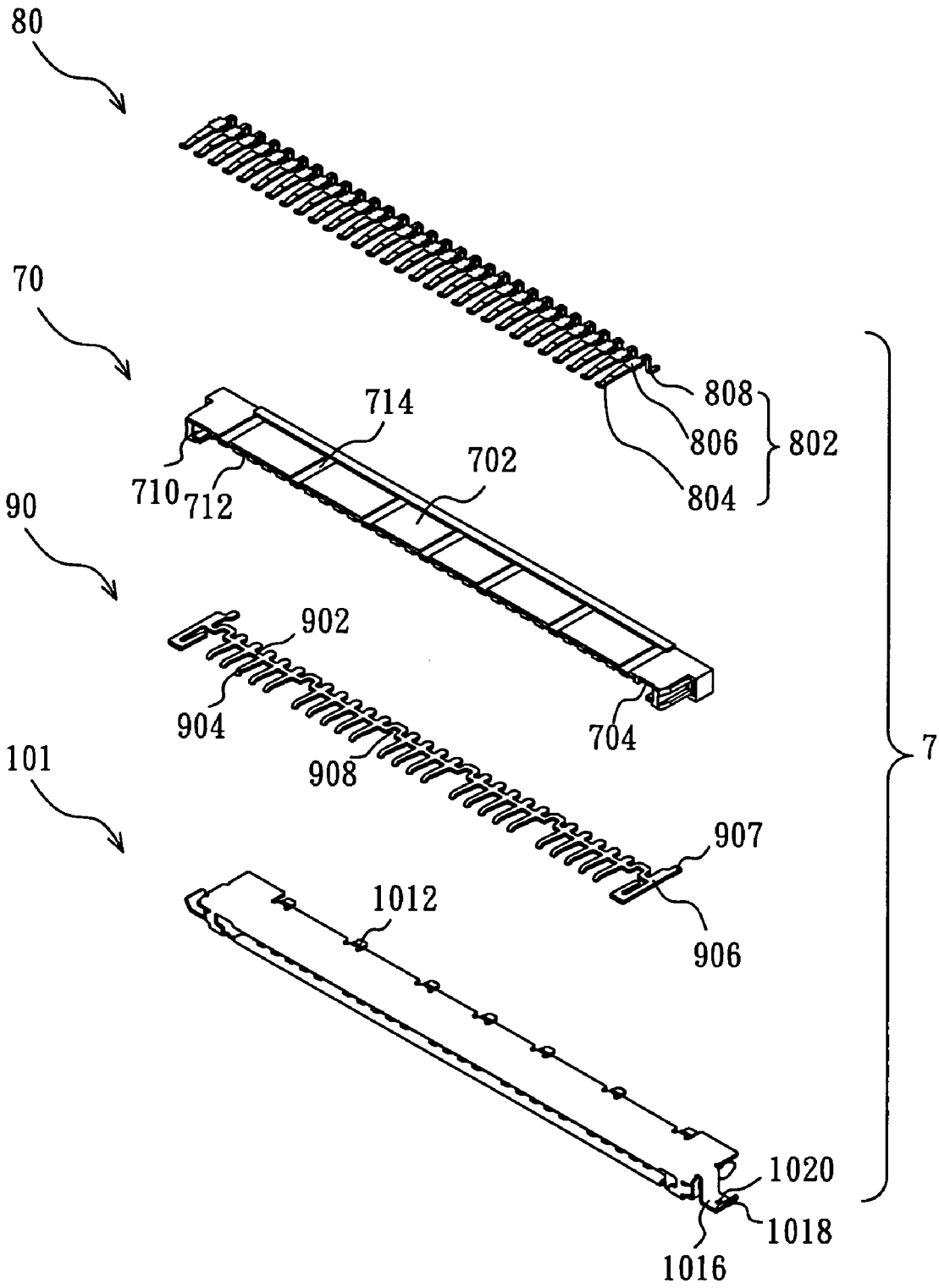
FIG. 6 is a disassembling structure diagram illustrating the electrical connectors in another angle of views in accordance with another embodiment of present invention.

Besides, in the prevent invention, the grounding component can also be designed as one-piece type with good holding intensity, please refer to FIG. 5 and FIG. 6, which are two disassembling structure diagrams illustrating the electrical connectors in different angles of views in accordance with another embodiment of present invention. An electrical connector 7 includes a insulating housing 70, a terminal component 80, a grounding component 90 and a metal shell 101. The insulating housing 70 with "]" shape approximately has a top surface 702, a bottom surface 704 (shown in FIG. 5) and a back surface 706 with a plurality of inserted holes 708 arranged thereon. Two fixed arms 710 are respectively formed on two sides of the insulating housing 70, and two fixed holes 711 respectively are formed on the backs of two fixed arms 710. The terminal component 80 includes a plurality of terminals 802 made by punching a metal piece, and every terminal 802 includes a contacting portion 804, a wedging portion 806 and a welding portion 808, wherein the wedging portion 806 is wedged into the inserted hole 708 to combine with the insulating housing 70. The grounding component 90 includes a main axis 902, a plurality of cantilevers 904 and two side arms 906, wherein, the indentations 908 are formed on the front edge of the main axis 902, the cantilevers 904 extends from the front edge of the main axis 902 between two adjacent indentations 908, two side arms 906 are respectively arranged on two opposite ends of the main axis 902, and the back of each side arm 906 stretches a welding piece. Further, by respectively wedging two side arms 906 into the fixed holes 711 of the fixed arms 710 of the insulating housing 70, the grounding component 90 is combined with the insulating house 70, and then the locations of the terminals 802 of the terminal component 80 correspond to the locations of the cantilevers 904 in the insulating house 70. The metal shell 101 partly covers the grounding component 90 and the insulating housing 70 to expose the welding portions 808 of the terminals 802, in order to make the welding portions 808 be welded on the PCB (not shown) easily. Furthermore, a plurality of interfering pieces 1014 corresponding to the indentations 908 are formed on the lower edge of rear of the metal shell 101, and when the metal shell 101 covers the grounding component 90, the interfering pieces 1014 interfere with the indentations 908 to strengthen the fabrication intensity of the grounding component 90 with the metal shell 101.

Continuously, the grounding component 90 is made by punching a metal piece, and the insulating housing 70 is made of the plastics. A plurality of guiding grooves 712 are formed on the bottom surface 704 of the insulating housing 712 (shown in FIG. 6) and correspond to the inserted holes 708. The terminals 802 of the terminal component 80 are guided along the guiding grooves 712 to wedge the wedging portions 806 of the terminals 802 into the inserted holes 708 and the contacting portions 804 of the terminals 802 are placed at the guiding grooves 712 to contact with the terminals of the male connector. Besides, a plurality of grooves 714 are formed on the top surface 702 of the insulating housing 70 and a plurality of insertions 1012 corresponding to the grooves 714 are formed on the upper edge of rear of the metal shell 101.

Wherein, two solder terminals 1016 are respectively extend outwardly from two sides of the top surface of the metal shell 101, and every solder terminal 1016 has a winding portion 1018 bended in a tilting angle which is between 45 degrees to 60 degrees, and a long hole 1020 is formed on the winding portion 1018. The winding portion 1018 and the long hole 1020 are used to increase the welding area to make the solder terminal 1016 be welded on the PCB with high stability. Besides, the solder terminal 1016 can be arranged in the middle of the metal shell 101 or over the metal shell 101 depending on the welding demand of the solder terminal 1016. The winding portion 1018 of the solder terminal 1016 also can be winded upwardly or downwardly to be welded easily.

Figure 7A:
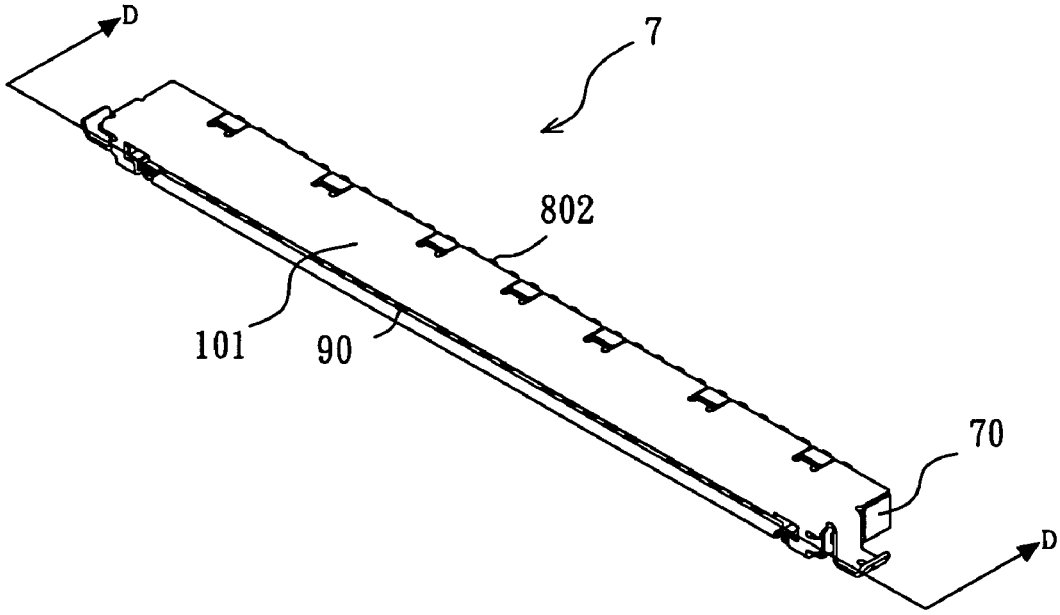
FIG. 7A is a three-dimension diagram illustrating the combinative electrical connector in accordance with the electrical connector in FIG. 6.
Figure 7B:
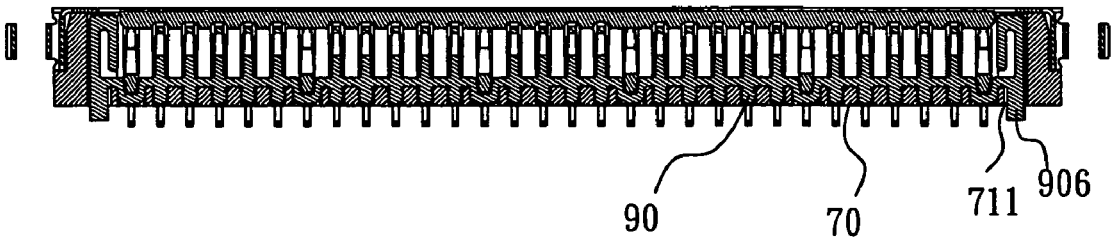
FIG. 7B is a cross-section diagram indicated by the section lines of D-D in FIG. 7A.
Figure 8A:
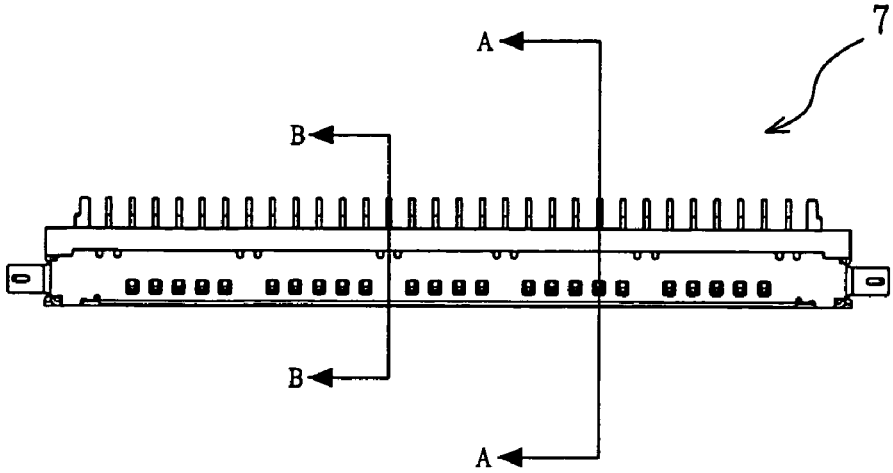
FIG. 8A is an upward view diagram illustrating the combinative electrical connector in accordance with one embodiment of present invention.
Figure 8B:
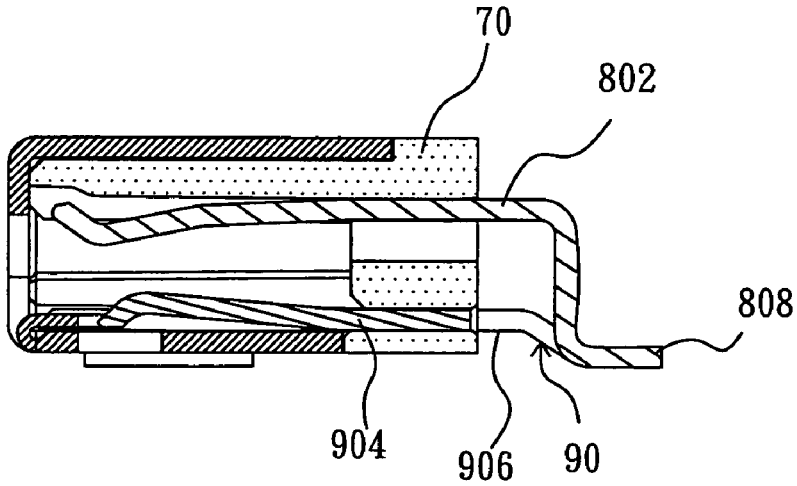
FIG. 8B is a cross-section diagram indicated by the section lines of A-A in FIG. 8A.
Figure 8C:
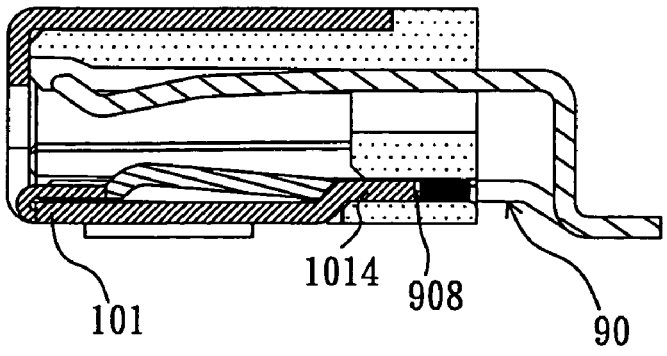
FIG. 8C is a cross-section diagram indicated by the section lines of B-B in FIG. 8A.
Figure 9A:
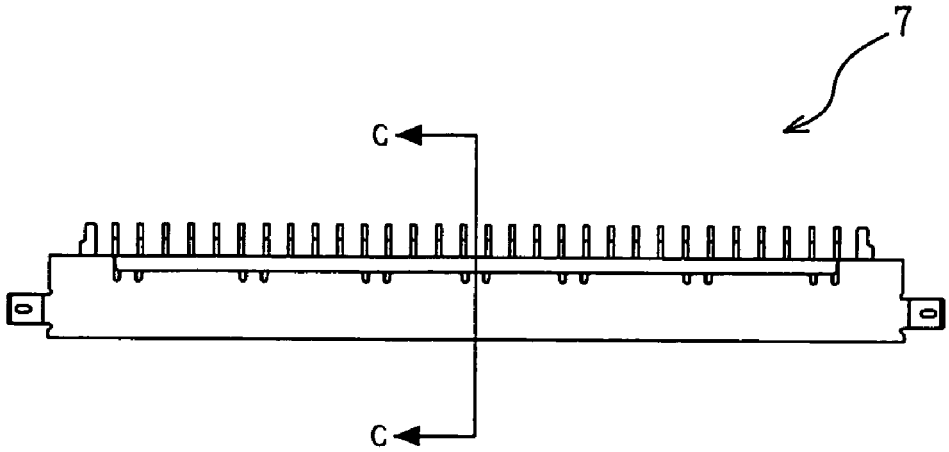
FIG. 9A is an vertical view diagram illustrating the combinative electrical connector in accordance with one embodiment of present invention.
Figure 9B:
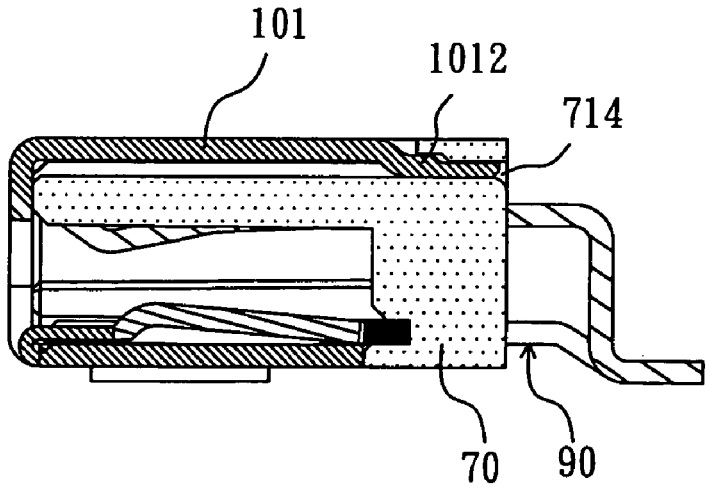
FIG. 9B is a cross-section diagram indicated by the section lines of C-C in FIG. 9A.

FIG. 7A is a three-dimension diagram illustrating the combinative electrical connector and FIG. 7B is a cross-section diagram indicated by the section lines of D-D in FIG. 7A. As shown in FIG. 7A, the metal shell 101 of the electrical connector 7 partly covers the grounding component 90 and the insulating house 70 to expose the portions of the terminals 802 to be welded on the PCB (not shown) easily. Wherein, as shown in FIG. 7B, two side arms 906 of the grounding component 90 are inserted into the fixed holes 711 from the front of the insulating housing 70 to combine the grounding component 90 with the insulating housing 70. Please refer to FIG. 8A, FIG. 8B, FIG. 8C, FIG. 9A and FIG. 9B at the same time, as shown in FIG. 8A, the terminals 802 are fixed within the insulating housing 70 and the welding portions 808 are exposed outside the insulating housing 70 to be welded on the PCB (not shown). The grounding component 90 is combined with the insulating housing 70 by the uses of two side arms 906, and the cantilevers 904 are within the insulating housing 70 and correspond to the terminals 802. Furthermore, as shown in FIG. 8C, the interfering pieces 1014 are inserted into the indentations 908 of the grounding component 90, and as shown in FIG. 9B, the insertions 1012 of the metal shell 101 are respectively inserted into the grooves 714 of the insulating housing 70, in order to make the combinations of the metal shell 101, insulting housing 70 and the grounding component 90 with good holding intensity.

Furthermore, when the male connector is inserted into the electrical connector 7, the loading forces of the contacting portions between the grounding component 90 and the terminal component 80 are equal due to the locations of the cantilevers 904 corresponding to the locations of the terminals 802, to avoid the unequal force causing the component damage which results the shortness of the life period of the electrical connector 7. Besides, the terminals 802 of the electrical connector 7 contact the terminals of the male connector by one to one, and the cantilevers 904 of the grounding component 90 contact with the metal shell of the male connector to reach the ground and obtain grounding effect.

To sum up, the present invention can achieve the purpose of facilitate the fabrication by inserting the grounding component from the front of the insulating housing to simplify the fabrication process. Furthermore, in order to effectively filtrate the noise interference and have good grounding effect, the cantilevers of the grounding component are arranged to correspond to the terminals of the electrical connector to ensure the signal transmission of the grounding circuits with high speed. Furthermore, the loading forces on the male connector are equal due to the cantilevers corresponding to the terminals, to avoid the unequal force causing the component damage which results the shortness of the life period of the electrical connector. Besides, by the design of the supporting rib, the structure intensity of the grounding component is strong enough to overcome the bend production in the middle of the grounding component due to its too wide and too thin design, and so as to not affecting the grounding effect in the middle of the grounding component, Besides, the supporting rib not only strengthens the structure intensity of the grounding component, but also ensures that the grounding component and the terminal component still have the good grounding effect in the limited design space. Furthermore, in the present invention, the winding portions of the solder terminals and the long hole on the winding portions are used to increase the welding area to make the solder terminal be welded on the PCB with high stability. Besides, the grounding component with one-piece type has the characteristics of simple and thin structure, not only to have the advantages of the simple fabrication and materials decrease, but also to decrease the setting space to fit the micro demand of the electrical connector. Besides, the interference effect between the grounding component and the metal shell increases due to the design of the indentations on the main axis of the grounding component to make the grounding component in the electrical connector with good holding intensity.

Although the present invention has been explained in relation to its preferred embodiment, it is to be understood that other modifications and variation can be made without departing the spirit and scope of the invention as hereafter claimed.

What is claimed is:

1. An electrical connector, comprising:

a terminal component with a plurality of terminals;

a grounding component comprising: a main axis, a folding piece, two side arms and a plurality of cantilevers, wherein, two ends of said main axis and two ends of said folding piece co-connect said two side arms, respectively, said plurality of cantilevers are formed on said main axis toward said folding piece and at least one of said cantilevers extends to said folding piece as a supporting rib, and each said side arm stretches an elastic piece on one end of said side arm;

an insulating housing covering said grounding component and said terminal component to make said terminals of said terminal component corresponding to said cantilevers of said grounding component and expose portions of said terminals;

a metal shell covering said insulating housing and exposing said terminals, wherein, said elastic piece stretches from said insulating housing to contact a inner wall of said metal shell; and two solder terminals extending form two sides of said metal shell and each solder terminal having a winding portion bended in a tilting angle.

2. The electrical connector according to claim 1, wherein, said metal shell comes one piece.

3. The electrical connector according to claim 1, wherein, said grounding component comes one piece.

4. The electrical connector according to claim 1, further comprising a plurality of insertions on a top surface and a bottom surface of said metal shell.

5. The electrical connector according to claim 4, wherein said insulating housing further comprises a plurality of grooves corresponding to said insertions.

6. The electrical connector according to claim 1, wherein said metal shell further comprises a partner-fitting portion with a periphery and two short sides of said periphery which are bended backwardly to form a guiding portion with chamfer type.

7. The electrical connector according to claim 6, further comprising a retaining wall formed on two long sides of said periphery to partly cover said insulating housing.

8. The electrical connector according to claim 1, wherein said folding piece of said grounding component partly covers said insulating housing.

9. The electrical connector according to claim 1, wherein, by using said elastic pieces, said grounding component is wedged in said insulating housing.

10. The electrical connector according to claim 1, wherein the shoulder portions of said terminals are covered in said insulating housing.

11. The electrical connector according to claim 1, further comprising a long hole on said winding portion of each said solder terminal.

12. The electrical connector according to claim 1, wherein said tilting angle of said winding portion is between about 45 degrees to about 60 degrees.

13. The electrical connector according to claim 1, wherein said winding portion of each said solder terminal is upwardly bended.

14. The electrical connector according to claim 1, wherein said winding portion of each said solder terminal is downwardly bended.

15. The electrical connector according to claim 1, wherein another end of each said side arm stretches a welding piece.

16. The electrical connector according to claim 15, wherein said welding piece and said elastic piece are toward the same direction.

17. The electrical connector according to claim 1, wherein said grounding component is inserted into said insulating housing from the front of said insulating housing.

18. A electrical connector, comprising:

a terminal component with a plurality of terminals;

a grounding component, comprising;

a main axis with a plurality of indentations on a front edge of said main axis;

a plurality of cantilevers extending from said front edge of said main axis and between any two adjacent said indentations; and two side arms respectively arranged on two opposite ends of said main axis;

an insulating housing covering said grounding component and said terminal component to make said terminals of said terminal component corresponding to said cantilevers of said grounding component and expose portions of said terminals; and a metal shell covering said insulating housing and exposing said terminals, wherein, a plurality of interfering pieces corresponding to said indentations are formed on a rear edge of said metal shell to interfere with said indentations.

19. The electrical connector according to claim 18, further comprising two fixed arms respectively formed on two sides of said insulating housing, and two fixes holes respectively formed on the backs of said two fixed arms to insert said two side arms.

20. The electrical connector according to claim 18, further comprising a plurality of grooves formed on a top surface of said insulating housing.

21. The electrical connector according to claim 20, further comprising a plurality of insertions formed on said rear edge of said metal shell to interfere with said grooves.

22. The electrical connector according to claim 18, wherein said terminal component comes one piece.

23. The electrical connector according to claim 18, wherein said grounding component comes one piece.

24. The electrical connector according to claim 18, further comprising two solder terminals extending form two sides of said metal shell and each solder terminal having a winding portion bended in a tilting angle.

25. The electrical connector according to claim 24, wherein said metal shell comes one piece.

26. The electrical connector according to claim 24, further comprising a long hole on said winding portion of each said solder terminal.

27. The electrical connector according to claim 24, wherein said tilting angle of said winding portion is between about 45 degrees to about 60 degrees.

28. The electrical connector according to claim 24, wherein said winding portion of each said solder terminal is upwardly bended.

29. The electrical connector according to claim 24, wherein said winding portion of each said solder terminal is downwardly bended.

30. The electrical connector according to claim 18, wherein one end of each said side arm stretches a welding piece.

* * * * *